United States Patent [19]

Coker

[11] 4,412,394

[45] Nov. 1, 1983

[54] DREDGING SUCTION-JET HEAD

[76] Inventor: Earnest Z. Coker, 1525 SW. 23, Oklahoma City, Okla. 73108

[21] Appl. No.: 416,413

[22] Filed: Sep. 9, 1982

[51] Int. Cl.[3] ..... E02F 3/88

[52] U.S. Cl. ..... 37/57; 37/62

[58] Field of Search ..... 37/57, 61, 62, 63; 299/8

[56] References Cited

U.S. PATENT DOCUMENTS

| | | | |
|---|---|---|---|
| 168,278 | 9/1875 | Newton | 37/63 |
| 619,727 | 2/1899 | Davis | 37/62 X |
| 669,192 | 3/1901 | Whisler | 37/62 |
| 811,275 | 1/1906 | Cole | 37/62 |
| 893,743 | 7/1908 | Moore | 37/62 |
| 967,797 | 8/1910 | Lovett | 37/62 |
| 1,688,109 | 10/1928 | Berry | 299/8 X |
| 1,851,565 | 3/1932 | Claytor | 299/8 |
| 2,125,740 | 8/1938 | Schacht | 37/57 X |
| 2,599,980 | 6/1952 | Dunning | 37/62 |
| 3,153,290 | 10/1964 | Saito | 37/62 |

*Primary Examiner*—Clifford D. Crowder

*Attorney, Agent, or Firm*—Robert K. Rhea

[57] ABSTRACT

A placer stream dredging head including a relatively short section of open end pipe coaxially secured to the depending end of a boat supported gangue tube. A closed bottom cage is connected with the depending end of the pipe section. A first force pump supplied water pressure hose is connected with the upper end portion of the pipe section in a manner to induce a jet action pressure reduction for lifting gangue into the gangue tube. A second force pump supplied water pressure hose is secured to the upper end portion of the pipe section and divided for exhausting downwardly directed high velocity water streams at diametrically opposite sides of the cage.

3 Claims, 5 Drawing Figures

DREDGING SUCTION-JET HEAD

BACKGROUND OF THE INVENTION

1. Field of the Invention

The present invention relates to a dredging type apparatus for processing the sand and gravel layer of placer-streams.

2. Description of the Prior Art

Prior patents generally disclose dredging apparatus for removing silt to deepen waterways, or lake beds.

Some prior patent dredging apparatus also disclose apparatus for obtaining gravel for concrete mix, or the like, but none of the patents, so far as I know, disclose a combination suction and jet head mounted on the depending end of a flexible gangue tube to be progressively moved across the bed of a placer stream for lifting sand and gravel and obtaining gold or other precious minerals comingled therewith.

SUMMARY OF THE INVENTION

A tubular dredging head is coaxially connected with the depending end of a flexible gangue tube, supported by a boat or barge on the surface of the placer stream, connected with a suction pump. The depending open end of the dredging head is surrounded by a cage having openings of smaller dimensions than the inside diameter of the head and gangue tube. A first water pressure tube, coextensive with the gangue tube and supplied by a force pump on the boat, extends at its depending end, into the upper end portion of the dredging head and terminates in a short tube projecting coaxially into the gangue tube to form a jet action stream of water assisting the reduced pressure in the gangue tube for lifting sand and gravel entering the cage in upward travel through the gangue tube. A second water pressure tube, coextensive with the gangue tube and similarly supplied with water by a force pump, is rigidly connected with the upper end portion of the dredging head where the second tube is divided to form gravel and sand loosening high velocity water streams on diametrically opposite sides of the cage.

The principal object of this invention is to provide a combination suction and jet head for connection with a boat supported flexible gangue tube for loosening and lifting precious metal bearing gravel and sand from placer streams to be processed by boat supported equipment as the boat is progressively moved along the placer stream.

DESCRIPTION OF THE PREFERRED EMBODIMENT

Figure 2:
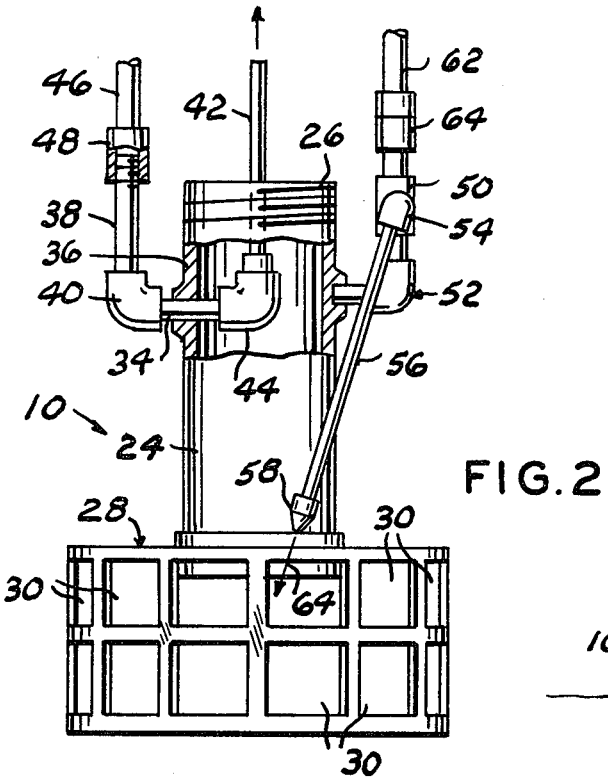
FIG. 2 is a side elevational view, partially in vertical section, to a larger scale, of the dredging head, per se.

Like characters of reference designate like parts in those figures of the drawings in which they occur.

In the drawings:

The reference numeral 10 indicates the dredging head adjacent the placer 14 connected with a flexible gangue tube 16, of selected diameter, for example, four inches, supported by a boom 18 mounted on a boat 20 on the surface of the stream 22. The boat end of the gangue tube 16 is connected with a vacuum pump, not shown.

Figure 4:
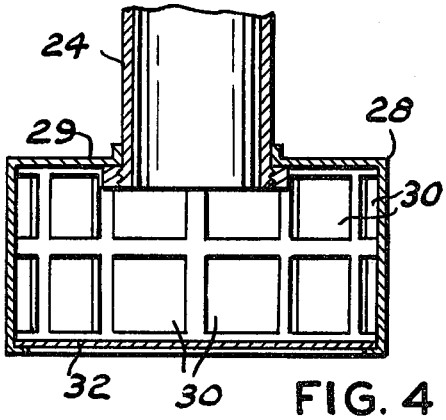
FIGS. 4 and 5 are fragmentary vertical cross sectional views taken substantially along the lines 4—4 and 5—5 of FIG. 3.

The head 10 comprises a short length of pipe 24 having external threads 26 at its upper end for coaxial connection with the depending end of the gangue tube 16. A cage 28, having a closed top 29, is coaxially connected to the depending end of the pipe 24. The cage 28 is generally cylindrical, preferably of greater diameter than the pipe 24 and of selected length, for example, one-half its diameter. The wall of the cage is characterized by a plurality of openings 30, each opening being of smaller diameter than the inside diameter of the pipe 24. The bottom of the cage is preferably closed by a plate 32 (FIG. 4).

Adjacent its upper end, the pipe 24 is provided with a short nipple 34 projecting through the wall 36 of the pipe 24 and rigidly secured thereto. An inlet nipple 38 is connected by an elbow 40 to the outwardly disposed end of the short nipple 34. A jet tube 42, of smaller diameter than the inlet nipple 38, is connected to the short nipple 34 by an elbow 44 coaxial with the pipe 24 and projects thereabove into the gangue tube 16 a selected distance. A first pressure hose 46, supplied with a stream of water under pressure by a force pump, not shown, on the boat 20, is coaxially connected with the inlet tube 38 by a quick coupling 48.

Figure 5:
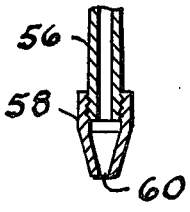

A tubular cross 50 has its downward opening rigidly connected with the wall of the pipe 24 opposite the inlet nipple 38 by an elbow and nipples 52. The lateral openings of the cross, extending transversely with respect to the longitudinal axis of the pipe 24, are provided with oppositely directed nipples and elbows 54 terminating in reduced diameter angularly downwardly projecting pressure nipples 56, each terminating in a nozzle 58 secured thereto disposed on diametrically opposite sides of the cage 28 adjacent the upper limit thereof. Each of the nozzles are provided with an orifice 60 (FIG. 5) for directing a high velocity stream of water toward the placer 14 to loosen sand and gravel to be picked up by the head. This is accomplished by a second pressure tube 62, coextensive with the gangue tube and supplied with water at its boat connected end by a force pump, not shown, and connected at its depending end with a quick coupling 64 mounted on the upward opening of the cross 50.

Operation

Figure 1:
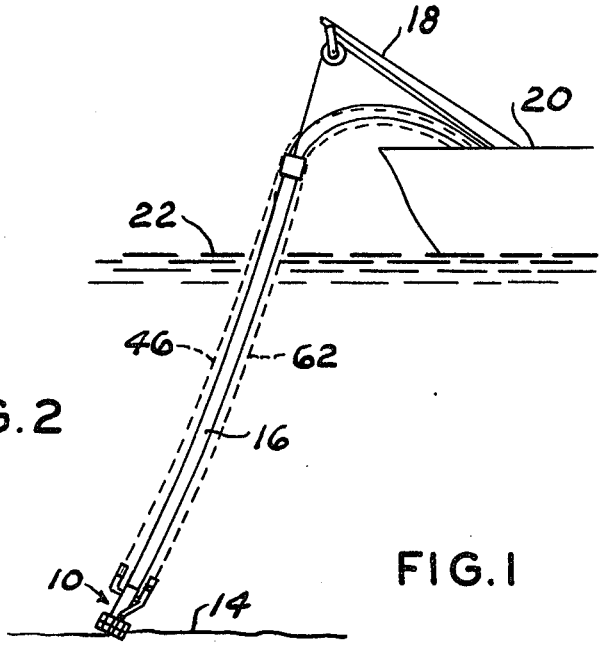
FIG. 1 is a diagram illustrating the device in operative position when supported by a boat on a placer stream.
Figure 3:
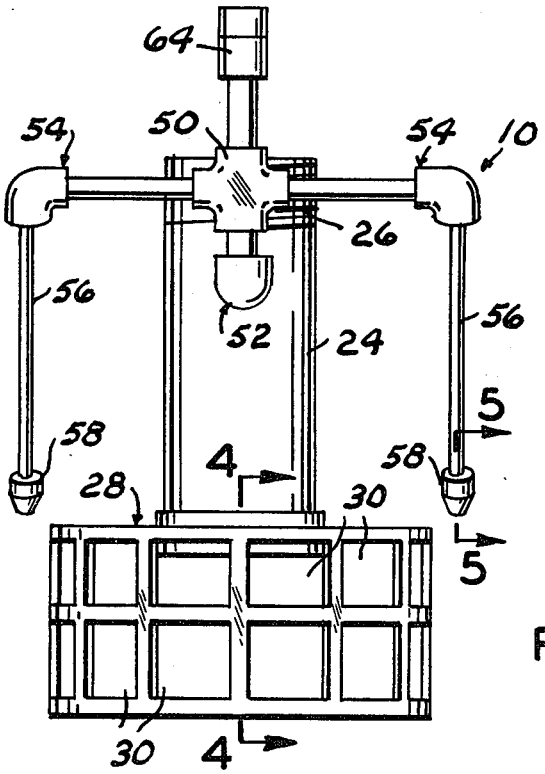
FIG. 3 is a right side elevational view of FIG. 2.

In operation, the head 10 is connected with the gangue tube 16 and pressure lines 46 and 62, as illustrated by FIG. 1. As the boat 20 moves across the water and moves the device 10 along the placer 14, high velocity streams of water, indicated by the arrow 64, emitted by the nozzles 58, loosen and stir up gravel and sand around the cage for entering the openings 30. The first pressure hose 46, by its pressurized stream of water emitting from the jet tube 42, reduces the pressure in the depending end of the pipe section 24 and gangue tube 16 so that water, sand and gravel is lifted through the gangue tube to the boat.

Obviously the invention is susceptible to changes or alterations without defeating its practicability. Therefore, I do not wish to be confined to the preferred embodiment shown in the drawings and described herein.

I claim:

1. In a boat supported placer-stream dredging apparatus having a generally vertical gangue tube extending from the placer above the surface of the stream and generating an upward flow of gangue therethrough and having first and second pressure hoses coextensive with the gangue tube and containing water under greater than atmospheric pressure, the improvement comprising:

a dredging head secured to the depending end of said gangue tube, said dredging head comprising, an open end section of pipe coaxially secured at one end portion to the depending end of said gangue tube, nipple means communicating with the first said pressure hose and extending through the wall of said pipe section for reducing stream water pressure within the pipe section by generating an upwardly directed jet action water flow therethrough, cage means consisting of a cylindrical member having a top end wall of greater diameter than said pipe section coaxially secured to the depending end portion thereof and having a closed bottom wall spaced from said top wall a distance at least equal to one-half its diameter, the wall of said cylindrical member having openings therein dimensioned for limiting the diametric size of gangue particles passing through the openings in response to lateral movement of the cylindrical member across a stream bed by the trailing action of the gangue tube following boat movement, a cross communicating with said second pressure hose and rigidly secured to said pipe section opposite said nipple means, and, angularly downward directed nozzle means communicating with said cross for impinging a high velocity stream of water on the gangue at opposite sides of said cage.

2. The combination according to claim 1 in which said nipple means comprises:

a short nipple projecting through the wall of said pipe section normal to its longitudinal axis;

an inlet nipple connected at one end with said first pressure hose and connected at its other end with the outward end of said short nipple; and, a jet tube connected with the other end of said short tube coaxial with said pipe section and having an open end projecting upwardly into said gangue tube.

3. The combination according to claim 2 in which said nozzle means comprises:

a pair of nozzles each having an outlet orifice; and, a pair of pressure nipples connecting said nozzles with said cross.

* * * * *